United States Patent [19]

Kohyama et al.

[11] Patent Number: 4,611,901

[45] Date of Patent: Sep. 16, 1986

[54] ELECTROPHOTOGRAPHIC METHOD AND APPARATUS

[75] Inventors: Mitsuaki Kohyama, Tokyo; Toshihiro Kasai, Yokohama; Haruhiko Ishida, Tokyo; Shigenobu Osawa, Kawasaki, all of Japan

[73] Assignee: Kabushiki Kaisha Toshiba, Kawasaki, Japan

[21] Appl. No.: 628,040

[22] Filed: Jul. 5, 1984

[30] Foreign Application Priority Data

Jul. 8, 1983 [JP] Japan ..... 58-124412

[51] Int. Cl.[4] ..... G03G 15/01; G03G 13/01

[52] U.S. Cl. ..... 355/4; 250/324; 355/3 CH; 355/14 CH

[58] Field of Search ..... 355/3 R, 3 CH, 4, 14 CH; 250/324, 326; 361/235

[56] References Cited

U.S. PATENT DOCUMENTS

| | | | |
|---|---|---|---|
| 3,076,092 | 1/1963 | Mott | 250/49.5 |
| 3,675,096 | 7/1972 | Kiess | 250/326 |
| 3,950,680 | 4/1976 | Michaels et al. | 355/3 CH X |
| 3,967,891 | 7/1976 | Rippstein | 355/3 CH |
| 4,033,688 | 7/1977 | Orthmann | 355/4 |
| 4,053,217 | 10/1977 | Mailloux | 355/4 |
| 4,308,821 | 1/1982 | Matsumoto et al. | 355/4 X |
| 4,335,420 | 6/1982 | Mitsuo et al. | 355/3 CH X |

FOREIGN PATENT DOCUMENTS 58-57139 4/1983 Japan .

*Primary Examiner*—Fred L. Braun

*Attorney, Agent, or Firm*—Cushman, Darby & Cushman

[57] ABSTRACT

An electrophotographic method according to the present invention forms a color image on a photosensitive drum by repeating a cycle of charging, exposure and development for a plurality of times. The second charging process for charging the photosensitive drum having a first visible image thereon is performed to temporarily discharge a predetermined charge and thereafter limit reaching of the predetermined charge on a surface of the photosensitive drum in accordance with a surface potential at the photosensitive drum.

17 Claims, 17 Drawing Figures

ELECTROPHOTOGRAPHIC METHOD AND APPARATUS

BACKGROUND OF THE INVENTION

The present invention relates to an electrophotographic method and apparatus for forming a color image on an image carrier such as a photosensitive body and, more particularly, to an electrophotographic method and apparatus for forming a color image by repeating a cycle of charging, exposure and development for a plurality of times.

Color recording using an electrophotographic technique has a long history, and various techniques have been proposed. Among them all, the most significant techniques which receive attention these days include a technique in which a light-emitting element such as a laser beam or an LED array is used to form an image on a photosensitive body, and a technique in which an optical system is used to write optical information digitized by a liquid crystal or an optical switching element utilizing the Faraday effect.

These techniques are the most significant for color recording for the following reasons. First, copy densities of individual color components conventionally are not reproduced faithfully due to a noncoincidence between spectral light intensity distributions of the individual color components. This is caused by color separation of the original image and a nonuniform spectral sensitivity distribution of the photosensitive body. Conventionally, in order to resolve this problem of color reproducibility, the processing speed is determined in accordance with the lowest spectral sensitivity of the photosensitive body. However, this restriction can be eliminated by using the abovementioned color recording techniques. Second, an S/N ratio can be improved since the optical signal is processed by an electronic circuit. Third, various applications such as electronic image processing (e.g., image information editing) are made possible upon incorporation of a computer.

In an electrophotographic apparatus using a method for writing digitized image data on a photosensitive body, reverse development is performed to visualize, as a toner image, that portion of the photosensitive body which is exposed by light beams. The reverse development method can decrease the load on a digital processing circuit and an optical scanning system with respect to scanning precision.

Basically, an image according to color electrophotography can be formed by repeating a cycle of charging, exposure and development for a plurality of times which are identical with the number of colors of the image. The electrophotographic apparatuses are divided into two types: one type wherein chargers, exposure units and developing units are each disposed in a number corresponding to the total number of colors of the reproduced image to perform the cycle of charging, exposure and developing for each color upon one revolution of the photosensitive body; and another type wherein only developing units are disposed in a number corresponding to the total number of colors of the image and a single charger and a single exposure unit are also disposed around the photosensitive body such that charging and exposure for each color is completed upon rotations of the photosensitive body. The former system has a large construction, but provides a short recording time. Thus, this system is promising from the viewpoint of practical applications.

The most preferable and advanced arrangement of the multicolor recording apparatus as described above is basically illustrated in FIG. 1. This apparatus will be described with reference to FIGS. 1 and 2.

An original placed on an original table 1 is exposed by a known exposure optical system 2, and light reflected by the original is separated by a known tricolor separation filter 3. Separated light is incident on an image reading element 4 of a photoelectric transducer type which comprises a charge-coupled device (CCD) array called a solid-state imaging device or image scanner, or a photosensitive (e.g., silicon) array. Thus, three color components can be converted to corresponding electrical signals. These electrical signals are supplied to a memory/data processor 5. Thereafter, the signals are supplied through an output circuit 6 to optical image scanning units 9, 10 and 11, each of which comprises a laser beam array, a light-emitting diode (LED) array or a liquid crystal shutter array. An electrophotographic photosensitive body 8 as an image carrier charged by a charger 7 to a predetermined potential V1 is exposed using the optical image scanning units 9, 10 and 11. In this scanning/exposure operation, three optical outputs (red, blue and yellow in this embodiment since the tricolor separation filter is used) obtained in accordance with the color components separated by the tricolor separation filter 3 are scanned with beams 9*a*, 10*a* and 11*a*, respectively. Developing bias voltage VB higher than a potential VR1 of the exposure portion is applied to electrophotographic developing units 12, 13 and 14, respectively corresponding to the colors of the exposure light beams, so as to perform reverse development and hence form a multicolor image having three colors. The color image formed on the photosensitive body 8 is transferred by a transfer corona discharger 16 to a recording paper sheet P supplied from a paper supply unit 15. Thereafter, the paper sheet P thus tranferred is separated by a separating unit 17 from the photosensitive body 8. The image formed on the paper sheet P is fixed by the heat of a fixing unit 18, and the paper sheet is exhausted to an exhaust tray 19 outside the electrophotographic apparatus, thus completing the copying operation. Meanwhile, a developer which is not associated with the developing operation and which is left on the photosensitive body 8 is removed by a cleaner 21 after the photosensitive body 8 is first discharged by a discharger lamp 20. Thereafter, the photosensitive body 8 is ready for the next copying cycle. According to the electrophotographic apparatus described above, an output from an external output device such as a computer and a word-processor can be connected to an input section 22 of the apparatus. Therefore, the apparatus can also be used as a multicolor printer for printing a multicolor image in accordance with color signals.

The present inventors have examined the conventional electrophotographic apparatus described above from various points of view and found the following problems.

The photosensitive body 8 charged by the charger 7 must maintain its charge thereon until it passes the third developing unit 14. However, in practice, the photosensitive body 8 can hardly comprise a photosensitive material which is uniformly charged for such a long period of time. Even if the photosensitive body 8 can comprise such a photosensitive material (e.g., pure selenium), the photosensitive material has a poor photosensitive property and has a spectral sensitivity restriction. Furthermore, even if the material has no restriction regarding spectral sensitivity, image quality is greatly degraded due to charge attenuation. In order to prevent such degradation of image quality, it is proposed that rechargers 23-*a* and 23-*b* for recharging the photosensitive body 8 prior to exposure for individual color components are arranged in front of the second and third developing units 13 and 14 so as to compensate a charge attenuation $\Delta V$ from the photosensitive body 8. The necessary, stable potential for development is thus guaranteed by the rechargers 23-*a* and 23-*b*.

In this case, however, a potential distribution of the photosensitive body 8 is illustrated in FIG. 2 wherein the potential VR1 of a portion E exposed by the exposure beam 9*a* and the potential V1 of a nonexposed portion, as indicated by broken lines, respectively, in FIG. 2, change to potentials VR2 and V2, as indicated by solid lines, respectively, after recharging is performed. In this case, the already developed portion E must not be applied with the developer when the second and subsequent color reverse development cycles are performed. For this purpose, the electrostatic contrast value (VB−VR2) for development must be smaller than the developing sensitivity of the developer. However, in practice, the potential of the portion which is once exposed cannot be restored to the original potential, that is, the potential of the portion which is not exposed, even when the initial potential V1 of the photosensitive body 8 is kept constant. For this reason, the portion developed by the first developing unit 12 is developed again by the developing units 13 and 14, thus resulting in overlapping of colors. As a result, a desired color cannot be obtained.

This problem is based on the fact that satisfactory results can be obtained only when the photosensitive body 8 is entirely discharged and charged again. Therefore, latent image discharge light source must be arranged in addition to the rechargers 23-*a* and 23-*b* and the apparatus cannot be made compact as a whole. Repeated exposure of the photosensitive body 8 in the vicinity of the rechargers 23-*a* and 23-*b* is not preferred because it leads to fatigue of the photosensitive body 8. The present inventors have found that a fatigue phenomenon of a highly sensitive photosensitive body which comprises a selenium-tellurium alloy photosensitive material or an amorphous silicon photosensitive material was accelerated when the photosensitive body was repeatedly exposed.

A first color toner or a second color toner is charged by corona discharge when recharging is performed. A third toner which is finally developed and is not charged by corona discharge has a charge greatly different from charges of the first or second color toner. Therefore, the transfer efficiency of the first or second color toner differs from that of the third color toner upon operation of the transfer corona discharger 16. In some cases, substantially no transfer operation can be performed depending on the toner colors. In this manner, when the conventional copying process is repeated several times to obtain a color copy, the non-transfer phenomenon described above becomes a great technical drawback.

SUMMARY OF THE INVENTION

The present invention has been made in consideration of the above situation, and has as its object to provide an electrophotographic method and a compact apparatus for forming a good color image without the undesirable color mixing caused by interference of the respective colors and for preventing a non-transfer phenomenon.

In order to achieve the above object of the present invention, there is provided an electrophotographic method for forming a color image on an image carrier by repeating a cycle of charging, exposure and development for a plurality of times, comprising a first step having a first charging process for charging an image carrier, a first exposure process for exposing said image carrier charged by said first charging process and forming on said image carrier a first latent image corresponding to a first image, and a first developing process for supplying a first developer to the first latent image and forming a first visible image on said image carrier; a second step having a second charging process for charging said image carrier having the first visible image thereon, a second exposure process for exposing said image carrier charged by said second charging process and forming a second latent image corresponding to a second image thereon, and a second developing process for supplying a second developer to the second latent image and forming a second visible image on said image carrier; and a third step for transferring the first and second visible images formed on said image carrier onto a sheet, the second charging process being performed to temporarily discharge a predetermined charge and thereafter limiting reaching of the predetermined charge on a surface of said image carrier in accordance with a surface potential at said image carrier.

Also, in order to achieve the above object of the present invention, there is provided an electrophotographic apparatus comprising an image carrier which is moved along one direction and on which first and second latent images are formed; first charging means for charging said image carrier; first exposing means for exposing said image carrier charged by said first charging means and forming a first latent image corresponding to a first image on said image carrier; first developing means for supplying a first developer to the first latent image and forming a first visible image on said image carrier; second charging means for charging said image carrier having the first visible image thereon; second exposing means for exposing said image carrier charged by said second charging means and forming a second latent image corresponding to a second image thereon; second developing means for supplying a second developer to the second latent image and forming a second visible image on said image carrier; and transferring means for transferring the first and second visible images to a sheet, said second discharging means including a first corona charger for discharging corona to charge said image carrier upon application of a voltage thereto, and limiting means, arranged between said first corona charger and said image carrier, for limiting reaching of a predetermined charge from said first corona charger on a surface of said image carrier in accordance with a surface potential at said image carrier.

DETAILED DESCRIPTION OF THE PREFERRED EMBODIMENT

An embodiment of an electrophotographic method and apparatus will now be described in detail with reference to FIGS. 3 to 11.

Figure 1:
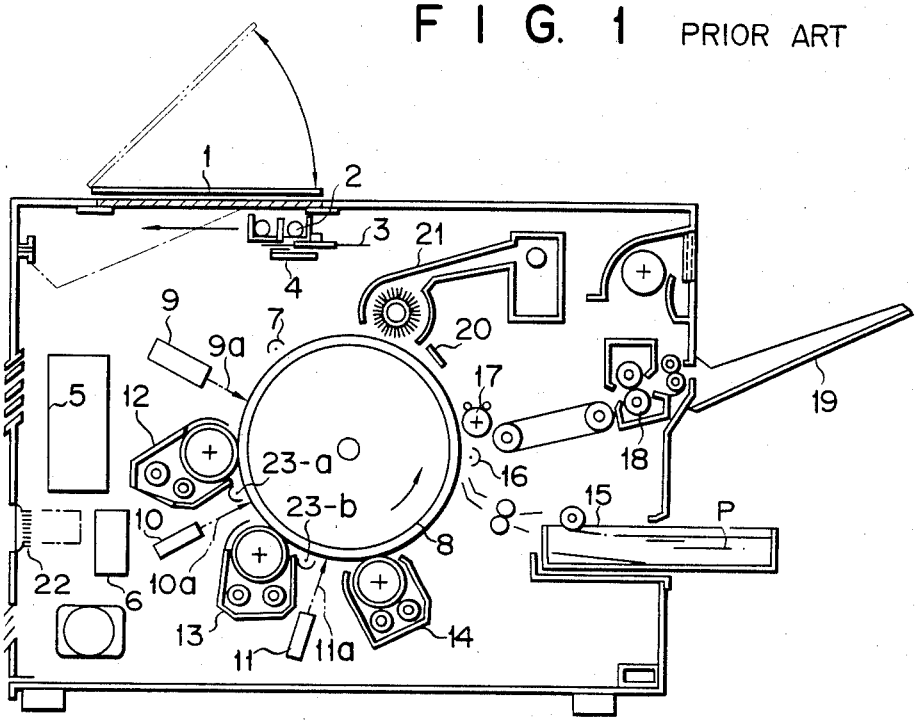
FIG. 1 PRIOR ART
FIG. 1 is a side view schematically showing a conventional multicolor copying apparatus.
Figure 2:
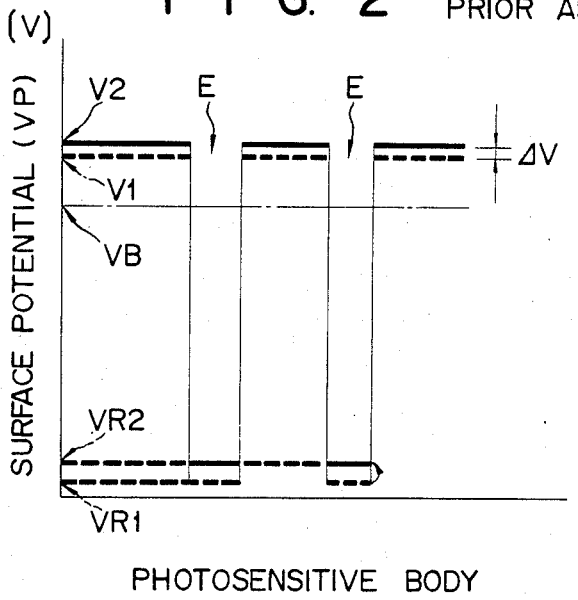
FIG. 2 PRIOR ART
FIG. 2 is a graph showing the distribution of the surface potential of a photosensitive body so as to explain the conventional problems.
Figure 3:
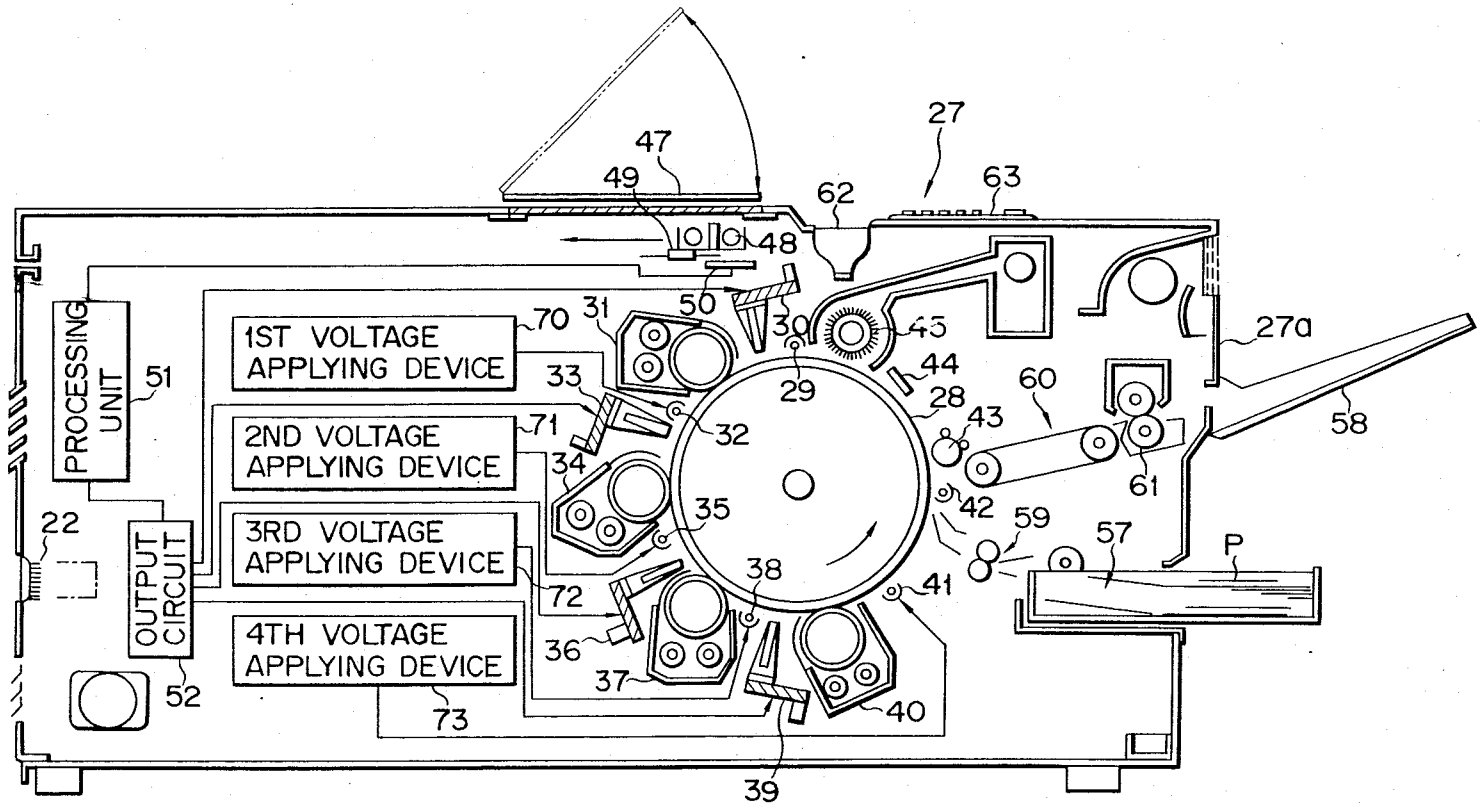
FIG. 3 is a side view schematically showing an electrophotographic apparatus of an embodiment according to the present invention.

In order to solve the conventional problems, the following two conditions must be satisfied. First, a charging potential VP at the respective developed positions of a photosensitive body must be sufficiently high in order to prevent undesired color mixing. Second, a potential VR1 at the exposed portion in the developed position must be higher than the developing bias potential. The present inventors conducted various types of experiments and found that a suitable recharger comprised a corona charger (scorotron charger) which had a grid member for applying a bias voltage. FIG. 3 shows an image forming apparatus employing such a corona charger (scorotron charger) having the grid member for applying a bias voltage as a recharger.

As shown in FIG. 3, an electrophotographic apparatus 27 of this one embodiment has a photosensitive body or drum 28 as an image carrier, which rotates counterclockwise. A charger 29, a first scanning unit 30, a first developing unit 31, a first recharger 32, a second scanning unit 33, a second developing unit 34, a second recharger 35, a third scanning unit 36, a third developing unit 37, a third recharger 38, a fourth scanning unit 39, and a fourth developing unit 40 are disposed around the photosensitive body 28 along the direction of rotation thereof so as to form a color image on the photosensitive body 28.

The first scanning unit 30 serves to form a latent image corresponding to a black component of an image on the photosensitive body 28. The first developing unit 31 is disposed to supply a black developer to the photosensitive body 28. The second scanning unit 33 serves to form a latent image corresponding to a red component of the image on the photosensitive body 28. The second developing unit 34 is disposed to supply a red developer to the photosensitive body 28. The third scanning unit 36 serves to form a latent image corresponding to a blue component of the image on the photosensitive body 28. The third developing unit 37 is disposed to supply a blue developer to the photosensitive body 28. The fourth scanning unit 39 serves to form a latent image corresponding to a yellow component of the image on the photosensitive body 28. The fourth developing unit 40 is disposed to supply a yellow developer to the photosensitive body 28.

A control charger 41, a transfer corona charger 42, a separating unit 43, a discharger lamp 44 and a cleaner 45 are disposed downstream of the fourth developing unit 40 (i.e., between the fourth developing unit 40 and the charger 29) along the direction of rotation of the photosensitive body 28, so as to perform image transfer from the photosensitive body 28 to the paper sheet P and cleaning of the photosensitive body 28 after the transfer operation.

Figure 4:
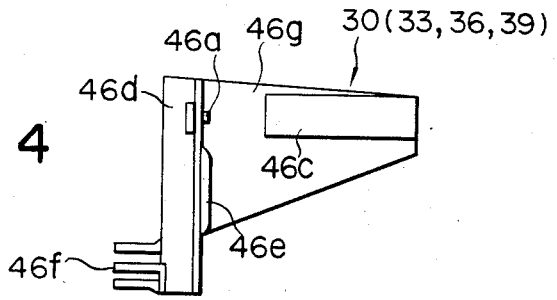
FIGS. 4 and 5 are respectively a side view and a perspective view of an optical scanning unit.
Figure 5:
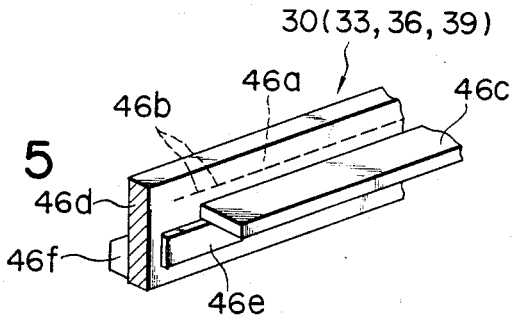

Each of the first to fourth scanning units 30, 33, 36 and 39 is arranged such that an array 46*a* (to be called an LED array hereinafter) of 16 light-emitting diodes 46*b* per 1 mm is coupled to a LED array lens ("Selfoc" lens) 46*c*. The LED array 46*a* is mounted on a ceramic base 46*d* together with a driver IC 46*e* and pins 46*f*. The converging photoconductive member 46*c* is mounted on the ceramic base 46*f* through a pair of holders 46*g* (only one holder is illustrated), as shown in FIGS. 4 and 5.

The first to fourth developing units 31, 34, 37 and 40 comprise known magnetic brush developing units, respectively.

An original table 47 is disposed on the upper surface of a housing 27*a* of the electrophotographic apparatus 27. A known exposure optical system 48 is reciprocally disposed below the original table 47 in the housing 27*a* so as to expose the original. A known tricolor separation filter 49 is mounted in the exposure optical system 48 to receive light reflected by the original and separate the reflected light into three color components. An image reading element 50 is disposed adjacent to the tricolor separation filter 49. The separated light beams from the tricolor separation filter 49 are incident on the image reading element 50 and are converted to electrical signals respectively corresponding to the three color components.

A processing unit 51 is arranged in the housing 27 *a* and is connected to the image reading element 50. The processing unit 51 stores the electrical signals from the image reading element 50 and processes them. An output circuit 52 is connected to the processing unit 51 to generate drive signals for driving the first to fourth scanning units 30, 33, 36 and 39 in accordance with the control signals generated therein. First to fourth voltage applying devices 70, 71, 72 and 73 are respectively connected to the rechargers 32, 35 and 38 and the control charger 41 so as to supply predetermined voltages to the rechargers 32, 35 and 38 and the control charger 41, as will be described later.

A cassette 57 is detachably mounted on one side surface of the housing 27*a* and stores a plurality of recording paper sheets P. An exhaust tray 58 which receives the copied sheets P is disposed at the housing side surface above the cassette 57. A first conveyor mechanism 59 is disposed in a space between the transfer section (a space defined between the transfer corona charger 42 and the photoconductive body 28) and the cassette 57 so as to convey the paper sheet P to the transfer section. This space is also defined by the transfer corona charger 42 and the photosensitive body 28. A second conveyor mechanism 60 is disposed between the transfer section and the first conveyor mechanism 59 so as to convey to the exhaust tray 58 the copied sheet P separated by the separating unit 43 from the photosensitive body 28. A fixing unit 61 is disposed in the second conveyor mechanism 60 to fix the toner image on the sheet P.

Reference numeral 62 denotes a display unit; and 63, a control panel for image processing.

The rechargers 32, 35 and 38 have an identical arrangement which is represented only by the first recharger 32.

Figure 6:
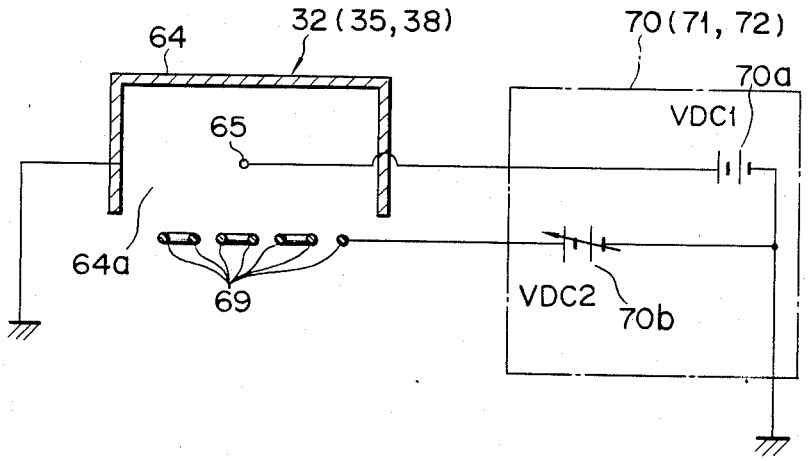
FIGS. 6 and 7 are a sectional view and a perspective view of a recharger, respectively.
Figure 7:
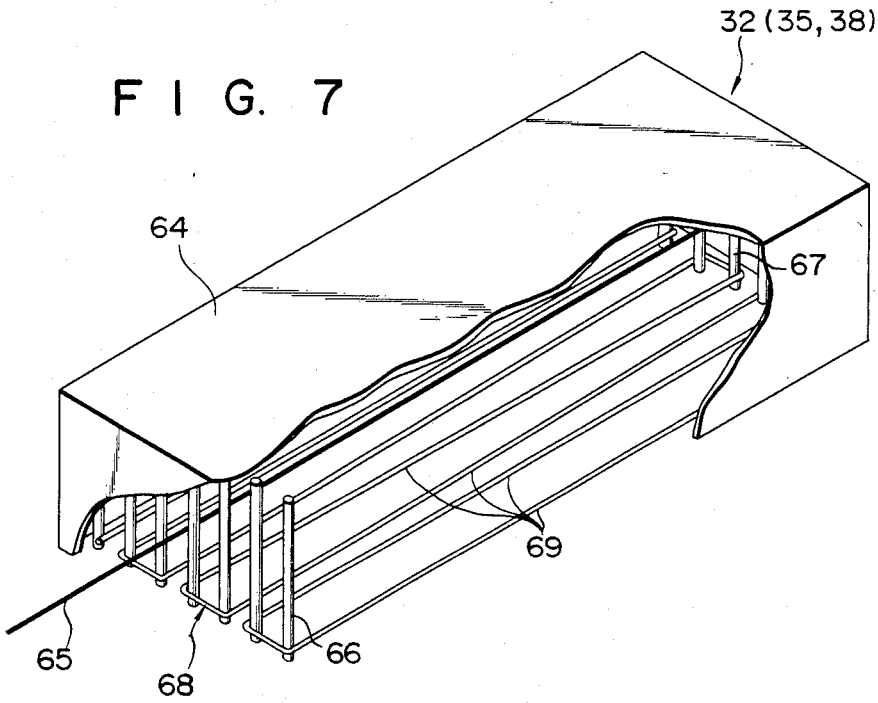

The first recharger 32 has a conductive housing 64 which has an opening 64*a* opposing the photosensitive drum 28, as shown in FIGS. 6 and 7. The housing 64 extends by at least the entire width of the photosensitive drum 28 along the axial direction thereof. At least one corona wire 65 extends inside the housing 64 along the axial direction of the photosenstive drum 28. One end of the corona wire 65 is insulated from the housing 64 and extends outside the housing 64. The other end of the corona wire 65 is connected to a terminal which is electrically insulated to the housing 64.

First mounting pins 66 and second mounting pins 67 extend downward from the two ends of the housing 64 which oppose the two ends of the photosensitive drum 28. Each of the first and second mounting pins 66 and 67 has an electrical insulation property and extends near the opening 64*a* of the housing 64. The first mounting pins 66 and the second mounting pins 67 are respectively aligned along the rotational direction of the photosensitive drum 28.

As shown in FIG. 7, a single wire 68 is looped between the first and second mounting pins 66 and 67. A plurality of portions of the wire 68 between the first and second mounting pins 66 and 67 are defined as grid wires 69. The grid wires 69 thus extend to be parallel to each other along the axial direction of the photosensitive drum 28. At the same time, these grid wires 69 are disposed near the opening 64*a* of the housing 64. In this manner, the first recharger 32 constitutes a scorotron charger.

The first, second and third rechargers 32, 35 and 38 are connected to first, second and third voltage applying devices 70, 71 and 72, respectively. Each of the first, second and third voltage applying devices 70, 71 and 72 has a first DC power source 70*a* and a second DC power source 70*b*. The second DC power source 70*b* comprises a variable voltage source. The positive terminal of the first DC power source 70*a* is connected to one end of the corona wire 65, and the negative terminal thereof is grounded. The positive terminal of the second DC power source 70*b* is connected to one end of the wire 68, and the negative terminal thereof is grounded. Note that the other end of the wire is connected to the other terminal which is electrically insulated to the housing 64.

Figure 8:
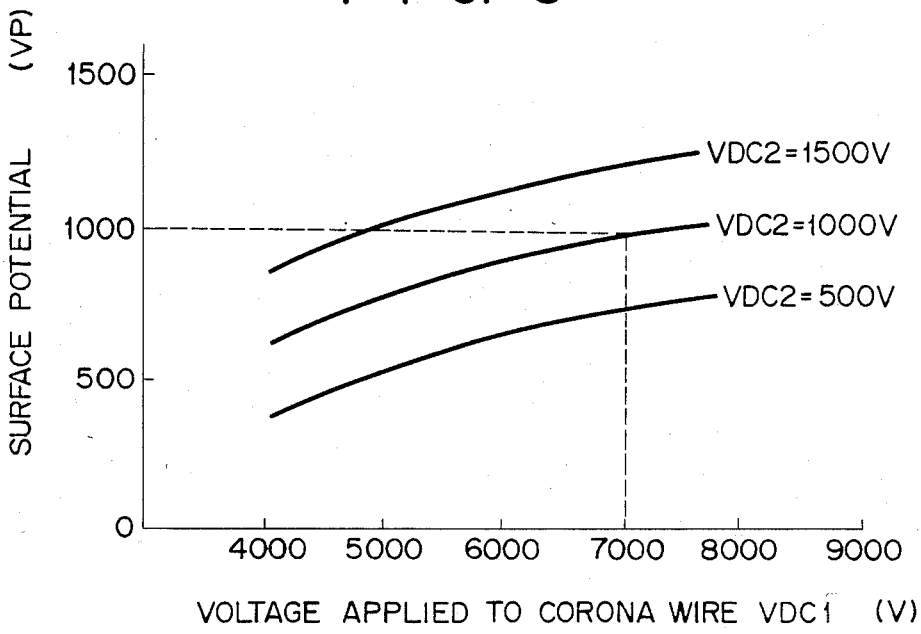
FIG. 8 is a graph showing a relationship between surface potential of a photosensitive body and a voltage from a first power source when a voltage applied to a corona wire varies.
Figure 9:
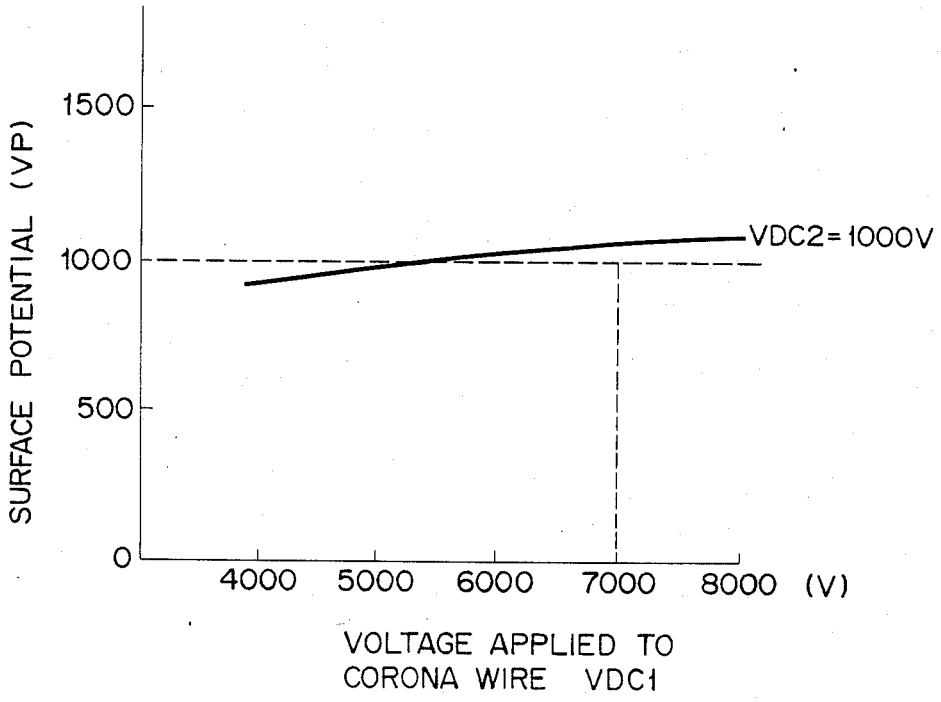
FIG. 9 is a graph showing a relationship between in surface potential of a photosensitive body and a voltage from the first power source when a voltage applied to a corona wire is fixed.

Various experiments were conducted when a DC voltage VDC1 was applied from the first DC power source 70*a* to the corona wire 65 of the first recharger 32 and a DC voltage VDC2 was applied from the second DC power source 70*b* to the grid wires 69 of the first recharger 32. FIG. 8 shows the relationship between the voltage VDC1 applied to the corona wire 65 and the surface potential at the photosensitive drum 28 when the surface potential is set at about 100 V and the voltage VDC2 applied to the grid wires 69 is used as a parameter. FIG. 9 shows the relationship between the voltage VDC1 applied to the corona wire 65 and the surface potential at the photosensitive drum 28 when the surface potential is set at about 950 V and the voltage VDC2 applied to the grid wires 69 are set at the voltage of 1,000 V.

When the voltage VDC1 applied to the corona wire 65 was set at 7,000 V and the voltage VDC2 applied to the grid wires 69 was set at 1,000 V, the potential (corresponding to the graph in FIG. 8) at the exposed portion of the photosensitive drum 28 could be corrected to a voltage of 1,000 V, and the potential (corresponding to the graph in FIG. 9) at the nonexposed portion of the photosensitive drum 28 could be corrected to a voltage of 1,050 V.

Figure 10:
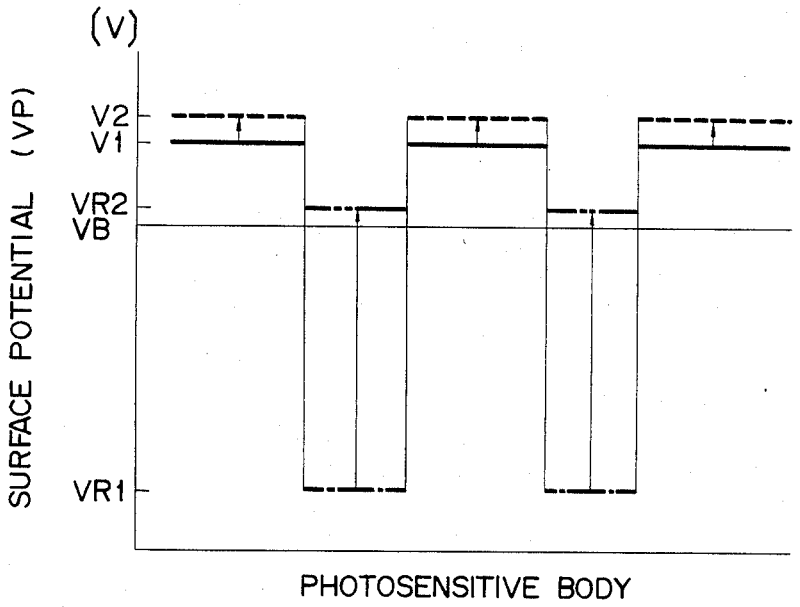
FIG. 10 is a graph showing surface potentials of exposed and nonexposed portions both prior to and after recharging when a recharger of a scorotron type is used.

Referring to FIG. 10, the thick solid line indicates the surface potential of the nonexposed portion prior to recharging, the broken line indicates the surface potential of the nonexposed portion after recharging, the one-dot and dashed line indicates the surface potential of the exposed portion prior to recharging, and the two-dots and dashed line indicates the surface potential of the exposed portion after recharging, all of which are considered along the circumferential direction of the surface of the photosensitive body.

In the apparatus according to this embodiment of the present invention, assume that a potential at the nonexposed portion of the photosensitive drum 28 immediately after passing the first charger 31 is given to be V1 and a potential at the exposed portion is given to be VR1, and that a potential at the nonexposed portion of the photosensitive drum 28 immediately after passing the recharger 32 is given to be V2 and a potential at the exposed portion is given to be VR2. The relationship between V1, VR1, V2 and VR2 was examined, and the results are shown in FIG. 10. In order to satisfy the developing conditions according to the apparatus of this embodiment, the potential V2 at the nonexposed portion is 1,000 V, and the developing bias voltage VB at the exposed portion is about 750 V. Referring to FIG. 10, in order to restore the voltage VR2 up to 750 V at the exposed portion, the present inventors found that a voltage applied to the corona wire 65 of 7,000 V and a voltage applied to the grid wires 69 of 1,000 V were suitable. In this case, a selenium-tellurium film having a thickness of 60 μm was used as the photosensitive film formed on the metallic drum, and the photosensitive drum 28 was rotated at a peripheral speed of 130 mm/sec.

As shown in FIG. 10, the present inventors found that a specific portion (exposed portion) on the photosensitive drum 28 could be sufficiently charged by recharging, and the nonexposed portion was slightly charged in accordance with the converging effect of the grid wires 69 in the first charger 32.

Furthermore, no adverse effects which disturb the unfixed image developed by the first cycle in accordance with the discharging conditions occur.

Figure 11:
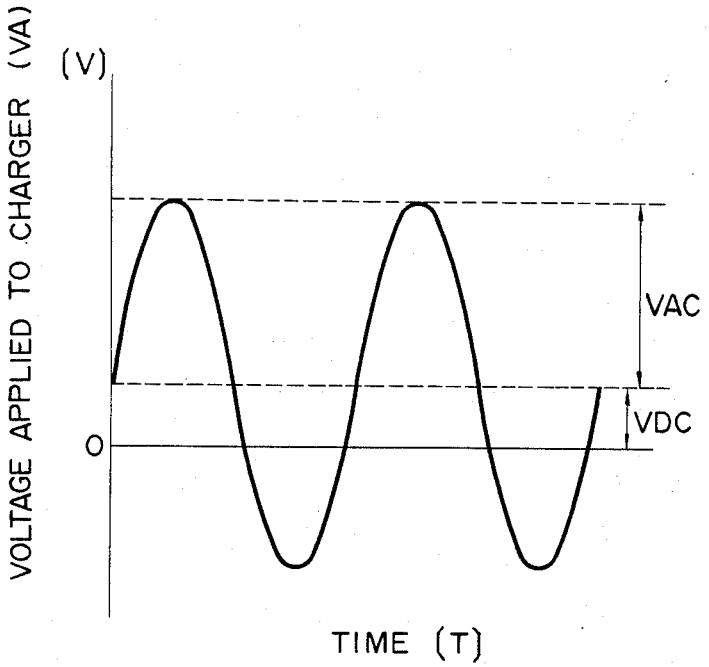
FIG. 11 is a diagram showing a waveform of a voltage applied to rechargers.

As shown in FIG. 3, the fourth voltage applying device 73 is connected to the control charger 41 to apply a voltage thereto. The fourth voltage applying device 73 is of AC-DC superposition type and a voltage VA consisting of the AC component VAC (400 Hz) and the DC component VDC, as shown in FIG. 11, can be generated from the fourth voltage applying device 73 to the control charger 41.

Figure 12:
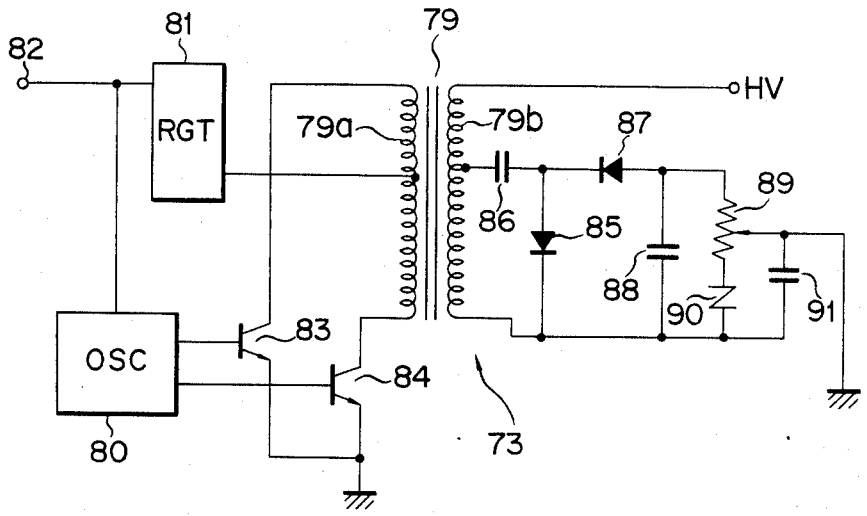
FIG. 12 is a circuit diagram of a voltage applying device for generating the voltage having the waveform shown in FIG. 9.

The fourth voltage applying device 73 comprises a boosting transformer 79 and an oscillator (OSC) 80 for oscillating first and second output signals whose phases are 180 degrees apart from each other, as shown in FIG. 12. Each output signal from the OSC 80 has a frequency of 400 Hz. The boosting transformer 79 has a primary coil 79*a* and a secondary coil 79*b*. The output terminal of an input control section (RGT) 81 is connected to the central tap of the primary coil 79*a*. The input terminals of the OSC 80 and the RGT 81 are commonly connected to a power supply terminal 82 of 24 V. A first transistor 83 is connected between one end of the primary coil 79*a* and ground, and its conduction state is controlled by the first output signal generated from the OSC 80. A second transistor 84 is connected between the other end of the primary coil 79*a* and ground, and its conduction state is controlled by the second output signal generated from the OSC 80.

A first capacitor 86 is arranged such that one end thereof is connected to the central tap of the secondary coil 79*b* and the other end thereof is connected to the other end of the secondary coil 79*b* through a first diode 85. Furthermore, a second capacitor 88 is arranged such that one end thereof is connected to the other end of the secondary coil 79*b* and the other end thereof is connected to the other end of the first capacitor 86 through a second diode 87. The first and second diodes 85 and 87 and the first and second capacitors 86 and 88 constitute a doubler rectifier.

A series circuit of a variable resistor 89 and a varistor 90 is connected between the two ends of the second capacitor 88. A slider of the variable resistor 89 is connected to the other end of the secondary coil 79*b* through a third capacitor 91 and is directly grounded. The variable resistor 89 serves as a DC control element. The fourth voltage applying device 73 has the configuration described above, so that a voltage consisting of an AC component and a DC component superposed thereon appears at an output terminal Hv, as shown in FIG. 12.

The operation of the electrophotographic apparatus 27 having the construction described above will now be described.

A DC positive voltage of 5.6 kV is applied by the charger 29 to the photosensitive body 28, so that the photosensitive body 28 is charged with a surface potential of 1,000 V (V1 = 1,000 V). The surface of the photosensitive body 28 is scanned with the first scanning unit 30 in accordance with the image optical signal which corresponds to the black image component and which is supplied from the image reading element 50 or the input section 22 to the first scanning unit 30. A latent image of the black image component is formed on the photosensitive body 28. First development is performed by the first developing unit 31 using the black developer (black toner). The voltage VDC1 of 7,000 V and the voltage VDC2 of 7,000 V are applied from the first voltage applying device 70 to the first recharger 32. The photosensitive body 28 is then scanned with the second scanning unit 33 in accordance with the image optical signal corresponding to the red image component, thereby forming a latent image corresponding to the red image component. This latent image is developed by the second developing unit 34 using the red developer (red toner). In the same manner as described above, the second and third rechargers 35, 38 have the same voltage applied thereto, and the third developing unit 37 using the blue developer (blue toner) and the fourth developing unit 40 using the yellow developer (yellow toner) are sequentially operated.

The four-color toner image formed on the photosensitive body 28 passes by the control charger 41 which controls the amount of charge of toner and which has a voltage applied thereto. This voltage consists of the AC component VAC of 5.0 kV and 400 Hz and the DC component VDC of 1.5 kV and is applied from the fourth voltage applying device 73 to the control charger 41. The toner image on the photosensitive body 28 is then transferred to the paper sheet P supplied from the cassette 57 since a voltage of −5.5 kV is applied to the transfer negative corona charger 42. The sheet P having the toner image thereon is separated by the separating unit 43 from the photosensitive body 28 and is fixed by the fixing unit 61. The fixed copied sheet P is then exhausted into the exhaust tray 58.

The color copy obtained by the color recording process under the above conditions is free of color mixing. Furthermore, by the effect of the control charger 41 operated in the same manner as the rechargers 32, 35 and 38, the toner charge amounts of individual colors can be uniformly controlled. So transfer corona discharge is performed to obtain good transfer efficiency. As a result, a four-color copy having a good transferred state can be obtained.

Figure 13:
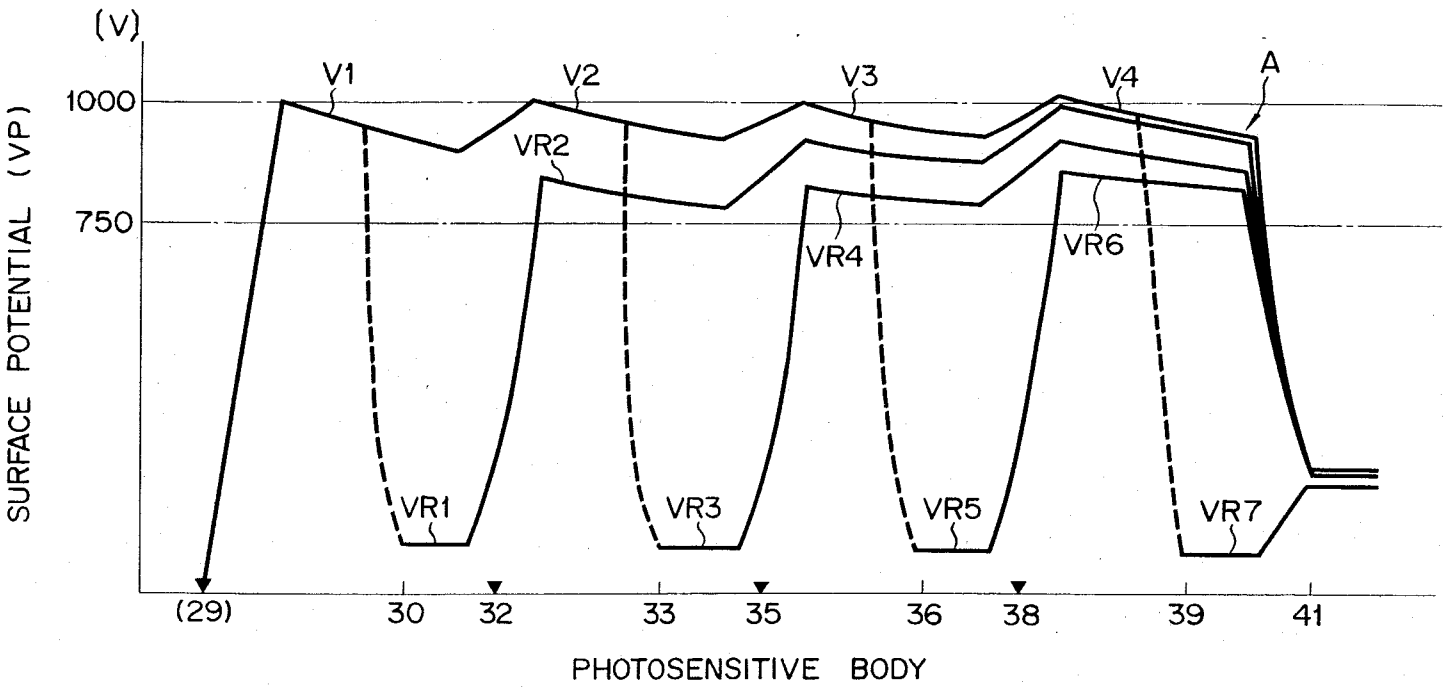
FIG. 13 is a graph showing the surface potential distribution at various positions on a photosensitive body.

FIG. 13 is a historical graph of surface potentials at an individual position of the photosensitive body 28. The numeric values plotted along the axis of the abscissa indicate reference numerals of the components (units) shown in FIG. 3. The potentials VR1, VR3 and VR5 at specific positions of the drum are obtained by exposing a portion corresponding to the positions by the first to third scanning units 30, 33 and 36 and are recharged to be higher than the voltage of 750 V, which level does not allow developing by units 34, 37 and 40. The potentials V1 to V3 of the nonexposed portions are increased by the rechargers 32, 35 and 38 by amounts corresponding to natural discharge (dark decay) of the photosensitive body 28, so that the nonexposed portions can be kept at the voltage of about 1,000 V throughout the whole process.

The potentials of the exposed portions which are developed by the four corresponding color toners (i.e., the potentials of the toner portions of the photosensitive body 28) vary as indicated by arrow A in accordance with the history of the corresponding color toners. Therefore, uniform conditions cannot be provided in the next transfer process. In other words, the first developer (black toner) is influenced by charge caused by the corona discharge at the time of recharging. For this reason, the first color toner has a potential greatly different from that of the fourth color toner (yellow toner). In this state, good transfer efficiency cannot be obtained with respect to the individual toners under operation of the corona charger 42. As a result, part of the image cannot be transferred, resulting in a significant problem.

However, according to the embodiment of the present invention, since the voltage is applied to the control charger 41 as described above, the surface potentials of the individual color toners can be a uniform voltage of about 200 V which is suitable for the transfer operation, thereby improving the transfer efficiency.

The present invention is exemplified by the above embodiment in accordance with the optimal conditions. However, as described above, a potential of the photosensitive drum can be arbitrarily set in accordance with a combination of the peripheral speed of the photosensitive drum and the DC voltage applied from the second DC power source 70*b* to the recharger. In addition, it is to be understood that the recharging potential is controlled in accordance with a developing system.

The present invention is not limited to the particular embodiment described above. In the above embodiment, the reverse developing method is used wherein the developer or toner is deposited on a latent image. However, as is apparent from the above description, the same effect can be obtained utilizing the normal development method. The present invention can also apply to the normal development method in accordance with similar procedures to those described above. In this sense, the present invention is not limited to the reverse development method. In the above embodiment, four-color reproduction is performed upon one revolution of the photosensitive body. However, an image can be formed by a plurality of revolutions of the photosensitive body under the condition that the cleaning is not operated. In this case, it will be readily understood that the voltage is applied to the recharger prior to the developing cycle by the individual color toners so that the same effect as in the above embodiment can be obtained. In this case, the transfer corona charger 42 and the control charger 41 are operated after the final development is completed.

Figure 14:
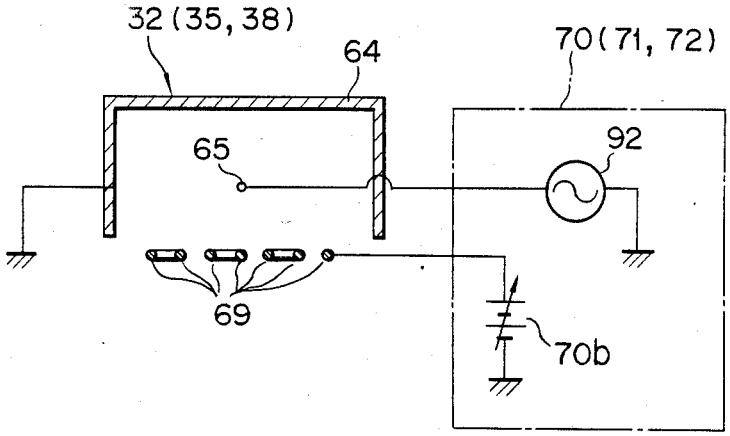
FIG. 14 is a sectional view showing a recharger of a first modification according to said one embodiment.
Figure 15:
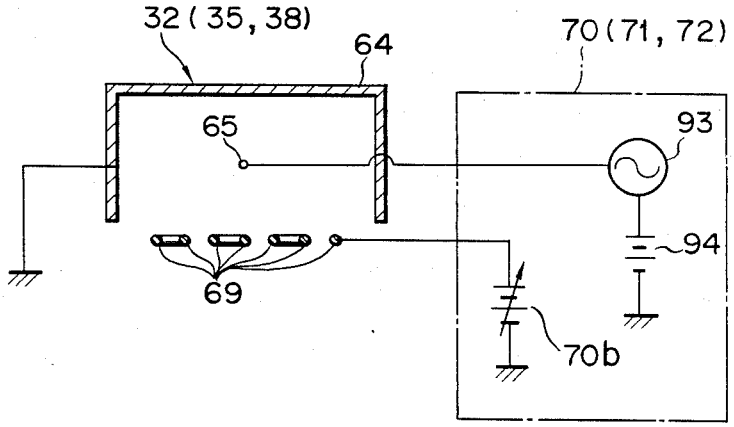
FIG. 15 is a sectional view showing a recharger of a second modification according to said one embodiment.

For example, the voltage applying device for the rechargers 32, 35 and 38 is not limited to the device 70 shown in FIG. 6. However, as a first modification of this embodiment, an AC power source 92 may be connected to the corona wire 65 as shown in FIG. 14. In this case, an AC voltage is applied to the corona wire 65. Furthermore, referring to FIG. 15 illustrating a second modification of this embodiment, a DC power source 94 and an AC power source 93 may be connected in series with the corona wire 65. In this case, a voltage obtained by superposing the DC voltage on the AC voltage is applied to the corona wire 65, thereby obtaining the same effect as in the above embodiment.

Furthermore, the number of grid wires 69 is not limited. The grid is not limited to wires, but may also comprise a mesh plate so as to obtain the same effect as in the above embodiment.

Figure 16:
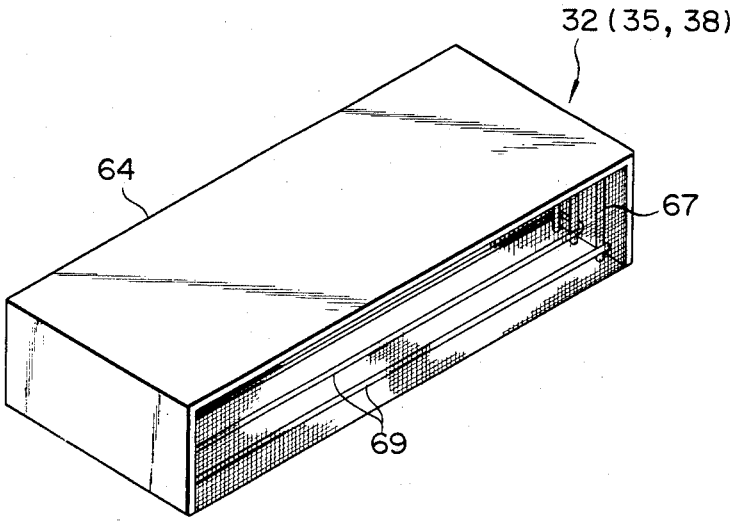
FIG. 16 is a perspective view showing a recharger of a third modification according to said one embodiment.
Figure 17:
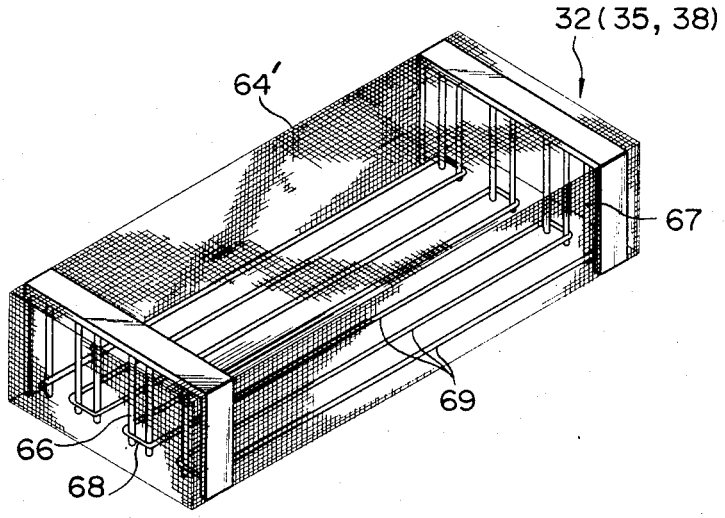
FIG. 17 is a perspective view showing a recharger of a fourth modification according to said one embodiment.

Referring to FIG. 16 illustrating a third modification of this embodiment, a housing 64 of the recharger need not comprise plates. The longer sides of the housing may comprise mesh plates, respectively. In this case, the heat dissipation effect can be improved. Furthermore, referring to FIG. 17 illustrating a fourth modification of this embodiment, the housing may comprise a mesh housing 64'. In this case, the heat dissipation effect can be much improved. Furthermore, in the above embodiment, color image recording is exemplified. However, the present invention is not limited to these embodiments. Various other changes and modifications may be made within the spirit and scope of the present invention.

What is claimed is:

1. An electrophotographic method comprising:

a first step having a first charging process for charging an image carrier, a first exposure process for exposing said image carrier charged by said first charging process and forming on said image carrier a first latent image corresponding to a first image, and a first developing process for supplying a first developer to the first latent image and forming a first visible image on said image carrier;

a second step having a second charging process for charging said image carrier having the first visible image thereon, a second exposure process for exposing said image carrier charged by said second charging process and forming a second latent image corresponding to a second image thereon, and a second developing process for supplying a second developer to the second latent image and forming a second visible image on said image carrier; and a third step for transferring the first and second visible images formed on said image carrier onto a sheet, the second charging process being performed to temporarily discharge a predetermined charge and thereafter limiting reaching of the predetermined charge on a surface of said image carrier in accordance with a surface potential at said image carrier, the second charging process including a process of charging said image carrier such that a surface potential of an exposed portion of said image carrier exposed by the first exposure process is substantially the same as that of a nonexposed portion thereof and a process of controlling the surface potential of the nonexposed portion not to increase compared with previous surface potential of said image carrier.

2. The method according to claim 1, wherein the first image has a predetermined color and the first developer has the same color as the first image, and the second image has a color different from that of the first image and the second developer has the same color as the second image.

3. The method according to claim 1, which further comprises a fourth step, performed between the second and third steps, for applying the AC voltage shifted by a predetermined level toward a polarity opposite to that of a voltage applied to a transfer charger and charging the first and second visible images on said image carrier prior to image transfer.

4. The method according to claim 3, wherein the fourth step includes a process of charging the first and second visible images such that a potential of the first visible image becomes substantially equal to that of the second visible image.

5. An electrophotographic apparatus comprising:

an image carrier which is moved along one direction and on which first and second latent images are formed;

first charging means for charging said image carrier;

first exposing means for exposing said image carrier charged by said first charging means and forming a first latent image corresponding to a first image on said image carrier;

first developing means for supplying a first developer to the first latent image and forming a first visible image on said image carrier;

second charging means for charging said image carrier having the first visible image thereon;

second exposing means for exposing said image carrier charged by said second charging means and forming a second latent image corresponding to a second image thereon;

second developing means for supplying a second developer to the second latent image and forming a second visible image on said image carrier;

transferring means for transferring the first and second visible images to a sheet; and third charging means, arranged between said second developing means and said transferring means, for charging the first and second visible images such that a potential of the first visible image becomes substantially equal to that of the second visible image;

said second charging means including:

a corona charger for discharging corona and changing the potential on said image carrier by applying a voltage thereto, limiting means, arranged between said corona charger and said image carrier, for limiting reaching of a predetermined charge from said corona charger on a surface of said image carrier in accordance with a surface potential at said image carrier.

6. The apparatus according to claim 5, wherein said corona charger includes:

a housing having an opening opposing said image carrier;

a corona wire extending inside said housing; and voltage applying means, connected to said corona wire, for causing said corona wire to discharge upon application of a voltage.

7. The apparatus according to claim 6, wherein said limiting means includes:

a plurality of grid wires disposed between said housing and said image carrier; and another voltage applying means, connected to said plurality of grid wires, for applying a voltage to said plurality of grid wires whereby said plurality of grid wires applied with the voltage from said another voltage applying means limits an amount of charges passing therethrough, so that an amount of charges reaching the surface of said image carrier corresponds to the surface potential at said image carrier.

8. The apparatus according to claim 7, wherein said another voltage applying means comprises a direct current power source.

9. The apparatus according to claim 8, wherein said direct current power source is variable.

10. The apparatus according to claim 7, wherein said plurality of grid wires extends to cross the opening of said housing.

11. The apparatus according to claim 6, wherein first voltage applying means comprises a direct current power source.

12. The apparatus according to claim 6, wherein said voltage applying means comprises an alternating current power source.

13. The apparatus according to claim 6, wherein said voltage applying means comprises an alternating current power source and a direct current power source connected in series with the alternating current power source.

14. The apparatus according to claim 6, wherein said housing comprises a pair of opposing side walls which are respectively made of mesh walls.

15. The apparatus according to claim 6, wherein said housing is made of a mesh.

16. The apparatus according to claim 5, wherein the first image has a predetermined color and the first developer has the same color as the first image, and the second image has a color different from that of the first image and the second developer has the same color as the second image.

17. The apparatus according to claim 5, wherein said third charging means includes:

another corona charger for discharging corona and changing the potentials of the first and second visible images upon application of a voltage thereto; and another voltage applying means, connected to said another corona charger, for applying to said another corona charger the AC voltage shifted by the predetermined level toward the polarity opposite to that of a voltage applied to said transferring means.

* * * * *